United States Patent [19]

Katakura et al.

[11] 4,350,328

[45] Sep. 21, 1982

[54] SHEET FEEDING APPARATUS

[75] Inventors: Hiroshi Katakura; Mitsuru Nagoshi, both of Hachioji, Japan

[73] Assignee: Konishiroku Photo Industry Co., Ltd., Tokyo, Japan

[21] Appl. No.: 205,711

[22] Filed: Nov. 10, 1980

[30] Foreign Application Priority Data

Nov. 15, 1979 [JP] Japan ..... 54/148130
Nov. 15, 1979 [JP] Japan ..... 54/148131

[51] Int. Cl.[3] ..... B65H 3/30

[52] U.S. Cl. ..... 271/22; 271/127; 271/160

[58] Field of Search ..... 271/160, 22, 127, 161

[56] References Cited

U.S. PATENT DOCUMENTS

| | | | |
|---|---|---|---|
| 3,687,448 | 8/1972 | Vora | 271/161 X |
| 3,857,558 | 12/1974 | Patel | 271/127 X |
| 4,212,456 | 7/1980 | Ruenzi | 271/127 X |
| 4,240,622 | 12/1980 | Rutishauser | 271/161 X |
| 4,256,237 | 3/1981 | Desmond | 271/22 X |

*Primary Examiner*—Richard A. Schacher
*Attorney, Agent, or Firm*—Linda G. Bierman; Jordan B. Bierman

[57] ABSTRACT

A sheet feeding apparatus includes a pivotally disposed tray for supporting a stack of sheets thereon, a sheet feeding roller positionally fixed proximate the leading edge of the uppermost sheet of a stack on the tray, a biasing member for urging the tray in opposition to the fixed feeding roller so that the uppermost sheet of the stack is pressed into frictional contact with the roller, and a wedge-shaped supplemental displacement member of a relatively light specific gravity material disposed intermediate the tray and a sheet stack supported thereon to displace the tray with respect to the feeding roller by an amount greater than that displacement otherwise imparted to the tray by sheets stacked thereon so as to increase the frictional feeding force with which the uppermost sheet is pressed against the feeding roller by the biasing member and thereby facilitate feeding of sheets having properties that might otherwise interfere with normal feeding from the tray.

5 Claims, 6 Drawing Figures

SHEET FEEDING APPARATUS

BACKGROUND OF THE INVENTION

1. Field of the Invention

The present invention relates to a sheet feeding apparatus for drawing out a pile of sheets such as plain paper and recording papers, one by one, (including the case of a pile thereof in a cassette), particularly to the structure enabling to feed special types of sheets having a heavy specific gravity or more rigidity or more thickness such that the powers for drawing out is insufficient as compared with usual sheets, for example, plain papers which are used for copying or recording machine.

2. Description of the Prior Art

Usually in an electrophotographic copying machines using plain papers as transfer sheets or recording sheets or in a facsimile transmitting apparatus, the sheet feeding apparatuses having a variety of structures are being used to draw out sheets one by one.

As a matter of course, such sheet feeding apparatuses are requested to have a simple structure, few troubles and a stability in operation. Among many conventional apparatuses used, good results have been produced by the apparatuses, for instance, having a structure shown in FIG. 1 in case of no cassette having been used, and having a structure shown in FIG. 4 in case of sheets having been piled in a cassette.

Referring to FIG. 1, the reference character A represents a paper feeding table at one end of which the base portion of the sheet feeding tray B is pivotally supported by the pin C. The member opposing to the free end of said sheet feeding tray B is the wall E which is provided on the main frame side for the purpose of regulatively positioning the ends of a number of sheets D set on said sheet feeding tray. Above the end (the free end) of said sheet feeding tray B, there is the roller type sheet feeding means F positioned so that each sheet D may be drawn out one by one from the top of sheets D piled by friction force with the process in operation. And, at a part of said sheet feeding tray B, there is a biasing member, i.e., the tension spring G, suspended to keep the upper surface of the end of top sheet D down to the circumferential surface of the sheet feeding means F. In such sheet feeding apparatuses having this type of structure, the suitable friction force generated between the sheet feeding means F and the sheet D may be obtained by observing the tension of the tension spring G in experiments and then by adjusting the tension force to a fixed degree, that is needless to say. However, in the paper feeding apparatus having such a type of the structures, there have been many cases difficult to feed sheets due to the shortage of force for drawing out sheets by sheet feeding means F, when heavy specific gravitative, thick or rigid sheets, other than sheets usually used, might be tried to feed.

Next, referring now to the example using a cassette, different from the aforedescribed example.

In FIG. 4 illustrating a conventional apparatus, the reference character H represents a cassette that is detachable from the main body of an apparatus and inside of which the base portion of a middle plate J is pivotally suspended so as to be movable as shown by the Fig., and also the fixedly positioned separation claws K are fitted up in the both corners of the front end of the cassette H in order to catch the upper most sheet and to protect from double feeding of sheets as publicly known. And, above the end (the free end) of said middle plate J, the sheet feeding means F comprising a roller for drawing out each sheet D one by one from the upper most thereof, by the aid of friction force. Further, the push lever L energized by the spring M is kept in upward contact with the bottom surface of said middle plate J. Therefore, in a sheet feeding apparatus having this type of construction, the suitable friction force generated between the sheet feeding means F and the sheet D may be obtained by adjusting the elastic force of the spring M at a fixed degree. However, as described above, in a sheet feeding apparatus having such this type of construction, there have been many cases difficult to feed sheets due to the shortage of the force for drawing out sheets when it has been desired to feed sheets having a heavier specific gravity, more thickness, or rigidity in comparison with plain papers and the like normally used.

SUMMARY OF THE INVENTION

An object of the present invention is to provide a sheet feeding apparatus, for the purpose of resolving the problems as described above which are also arisen in using a cassette, definitely without any change or revision of design specifications of paper sheet apparatus being usually used, to enable itself when necessary to feed such special sheets making shortage of the force for drawing out.

BRIEF DESCRIPTION OF THE DRAWINGS

Referring to FIG. 2 and FIG. 3, one of the examples of the present invention will be hereinafter described as follows:

Figure 1:
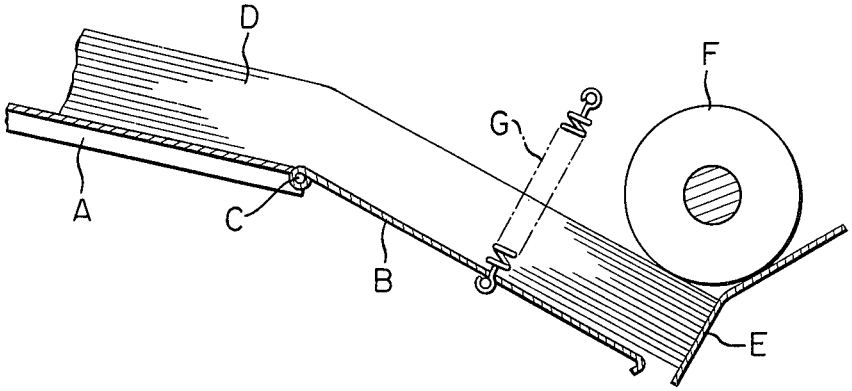
FIG. 1 and FIG. 4 are the descriptive diagrams of conventional sheet feeding apparatuses.

In Figs., reference numeral 1 designates a machine housing, 2 denotes secondary sheet feeding rollers, 3 represents a sheet guide, 4 is a drum and 5 denotes a transfer electrode, respectively.

Wherein, the secondary sheet feeding rollers are arranged on the midway of the sheet transport passage to secure to place a sheet upon a toner image area which is formed by a publicly known process, onto the photosensitive drum 4, and in case that, for instance, an end of sheet fed by sheet feeding means 11 hits against said rollers when a print button (not shown in the figure) is pushed, said sheet feeding rollers are at a standstill, (normally, it is designed so that an end of sheet may squeeze in between said secondary rollers.), and then it is regulated so as to draw out said sheet when a subsequent timing signal generated. With respect to such a regulation, the description thereof is omitted here because of no close relation to the present invention. At the sheet feeding gate 6 provided on said machine housing, the sheet feeding table 7 is provided on which a number of papers may be placed, and at one end of which the base portion of said sheet feeding tray 8 is pivotally supported by the pin 9. The upper surfaces of both sheet feeding table and sheet feeding tray are inclined downward to the sheet feeding means. And, in contraposition to the end of said sheet feeding tray 8 (the right side end in the figures) as illustrated also in FIG. 1, the wall 10 is positioned for the purpose of regulating the position of the ends of sheets D set on the sheet feeding tray 8. Above the end of said sheet feeding tray 8, the sheet feeding means 11 comprising a roller adjacent to said secondary sheet feeding rollers 2 is positioned. Also, at a part of said sheet feeding tray 8, an end of the biasing member (the tension spring 12 is shown as an example in the figure) is suspended for keeping the upper surface of the end of sheet D on the tray 8 down to the circumferential surface of said sheet feeding means 11. The other end of said biasing member is, for instance, fixedly suspended on the machine frame. The illustration is omitted herein, however, a publicly known manually operated lever is coupled to said tray 8, and when sheets D are set on the tray 8, the sheet feeding tray 8 is descended by said manually operated lever resisting the tension spring 12.

According to the present invention, the suitably thick supplemental displacement member 13 having a light specific gravity is placed on said sheet feeding tray 8 if occasion demands. The words, "light specific gravity", may not easily be defined, however, for instance, it may be indicated that a certain specific gravity would be lighter than that of sheets being usually used. Therefore, "a member having a light specific gravity" is made of certain materials satisfying such conditions as described above. However, due to the facts that such specific gravity may appropriately be decided by the interrelation of the other factors constituting an apparatus such as a tension of the tension spring and weight of the sheet feeding tray, and that the objects of the present invention do not relate to any material of said member having a light specific gravity, it is requested to understand that said member has such sizes, shapes and weights as suitable for this type of apparatuses.

The member 13 having a light specific gravity may be made of foam styrol, wood, hollow synthetic resin material, corrugated cardboard and so like provided with vinyl coat or the like on its surface. In said example, said member has the section in shape of an almost triangle and one part of which is formed so as to have the same thickness. Further, its higher portion is so positioned underneath the drawing-out roller 11 and its lower portion is so positioned at the slight rear of the sheets D.

Figure 2:
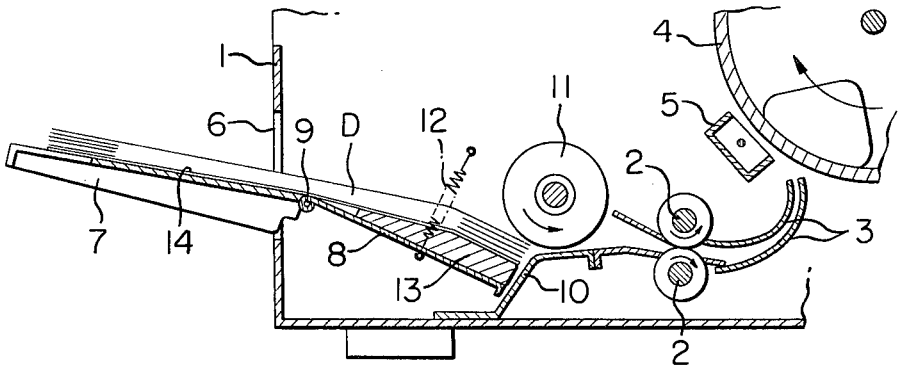
FIG. 2 and FIG. 5 are the sectional views of sheet feeding apparatuses relating to the present invention applied to an electrophotographic copying machine.
Figure 3:
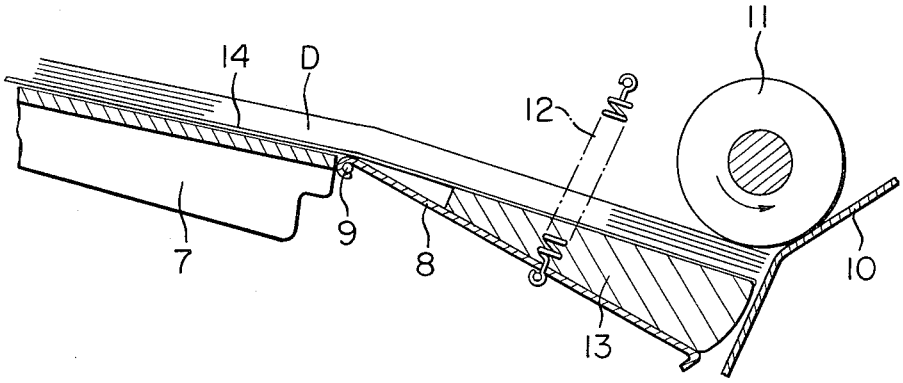
FIG. 3 and FIG. 6 are the expanded sectional views of said sheet feeding apparatuses.
Figure 4:
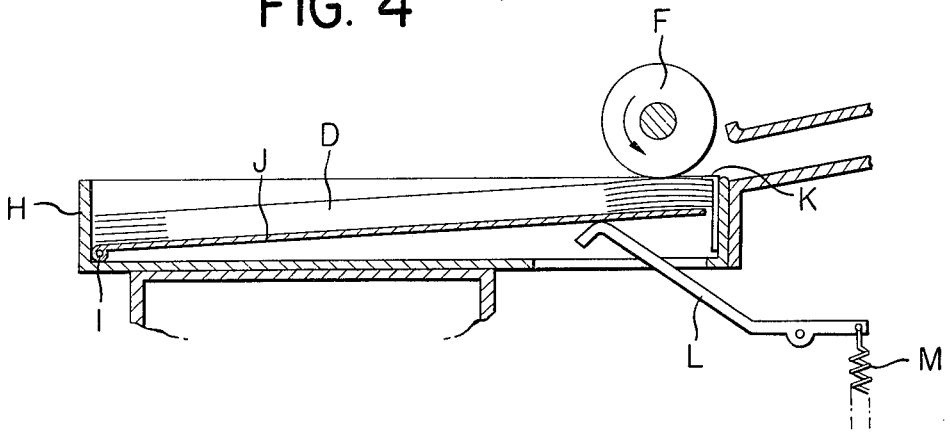

The reference numeral 14 represents a synthetic resin film or sheet arranged so that said member 13 having a light specific gravity may easily be fitted up at a fixed position on said sheet feeding tray, and may easily be removed from said sheet feeding tray. And, a part of said synthetic resin sheet is glued upon the surface of said member 13 having a light specific gravity and the rear part thereof is extended over to the sheet feeding table 7. This is very convenient, as shown in FIG. 2, in case of such construction as that the sheet feeding tray is hidden inside of the apparatus and is directly untouchable by hand. Concretely, when the member 13 is to be positioned on the sheet feeding tray, that will be done by pushing the member in while holding an end of the sheet 14 by hand, and to the contrary when the member 13 is to be removed from the sheet feeding tray that will be done by pulling said sheet 14 to this side (the left side in the figure). Further, even when sheets are placed on the member 13 after the member has been loaded, it has the effect that the sheet 14 will make the movements of sheets smooth. However, in an apparatus having such a structure as that the sheet feeding tray is initially manufactured with member 13 entirely outside of the apparatus or that manual operation may be done, it would be unnecessary in particular to provide synthetic resin sheet 14.

According to said example, even when feeding the sheet D having a heavier specific gravity, more rigidity and thickness in comparison with the sheets normally used, that is, the sheets D coming within the category of so-called special type of sheets for an apparatus, the friction force generated between the sheet feeding means 11 and the sheet D increases because the tension spring 12 is stretched more than in normal state thereof by arranging the member 13 having a light specific gravity on the sheet feeding tray 8, therefore it becomes possible to draw out sheets even if such sheets would normally encounter a shortage of force for drawing out.

Figure 5:
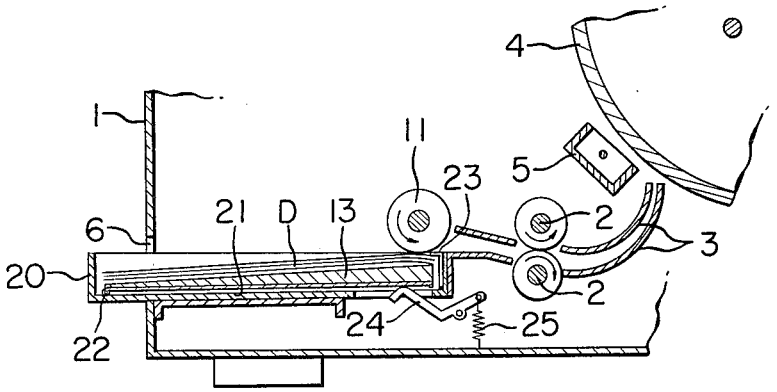
Figure 6:
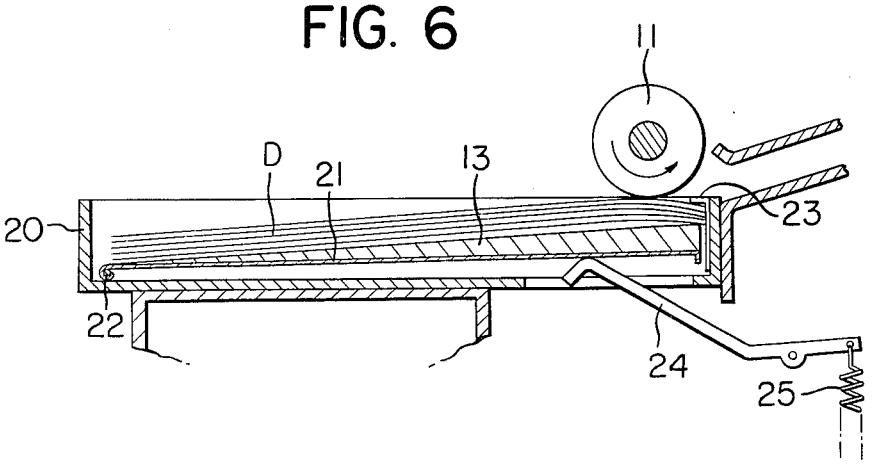

Referring to FIG. 5 and FIG. 6, which show an another embodiment according to the present invention.

In the Figs., the same reference numerals are designated to the same parts or members with the ones in the previous figures, therefore the description thereof may be omitted depending upon the circumstances.

On an apparatus housing 1, the gate 6 for attaching cassette is formed, to which a cassette 20 may be inserted and attached. The sheets D are in said cassette 20 and placed on the axially movable middle plate 21 provided on the bottom plate (no reference symbol). In both corners of the front end of the cassette 20, where are arranged a pair of the separation claws 23, by which the sheet D to be drawn out and a pile of other sheets D are separated from each other. Above the end of said middle plate 21, the sheet feeding means 11 comprising a roller is positioned. Meanwhile, the push lever 24, which always hold the sheets D in the cassette 20 down in the direction of the sheet feeding means 11, is kept in upward contact by a part thereof with the bottom surface of said middle plate 21, and the tension spring 25 is suspended on the push lever 24. In addition thereto, although the illustration is omitted, such manually operated lever as the one in the description of the afore-mentioned example is coupled to said push lever 24 which is withdrawn from the cassette 20 by using the manually operated lever when the cassette 20 is attached to or detached from an apparatus.

According to this embodiment, the member 13 having a light specific gravity for special sheets use is placed on said middle plate 21. The member 13 having a light specific gravity has an almost similar shape and is made of the similar materials, to those of the aforementioned example.

Also, according to this embodiment, when necessary for feeding the sheets D having a heavy specific gravity, more rigidity or more thickness, the purpose will be done only by arranging the member 13 having a light specific gravity on the middle plate 21 in the cassette 20 and by placing sheets D thereon. That is, by doing so the tension spring 13 which energizes the push lever 24 is stretched more than in a normal state, therefore, the friction force generated between the sheet feeding means 11 and the sheet D is increased by contraries. Consequently, the drawing-out operation may securely be made even if using special type of sheets which are short of the force for drawing out.

After all, according to the present invention, special type of papers such as the one as described before may also be fed only by attaching or detaching a member having a light specific gravity without any change or revision of normal designing specification, therefore, there are the effects applicable to the presently existing sheet feeding apparatuses too.

What is claimed is:

1. In an apparatus for feeding sheets from a stacked supply thereof, a tray for supporting a stack of sheets and from which the uppermost sheet of a stack supported thereon is feedable at a leading edge thereof, a sheet feeding roller operatively rotatable for drawing the uppermost sheet from a sheet stack supported on said tray and positionally fixed with respect to said tray proximate the leading edge of the uppermost sheet, biasing means for urging said tray in opposition to said feeding roller so that the uppermost sheet of a stack supported on said tray is pressed into frictional contact with said roller, whereby operative rotation of said roller causes the uppermost sheet to be fed from the stack, and supplemental displacement means on said tray between the tray and sheets stacked thereon for displacing said tray with respect to said feeding roller by an amount greater than that displacement otherwise imparted to the tray by the sheets stacked thereon so as to increase the urgency with which the uppermost sheet is pressed into frictional contact with said roller and thereby facilitate feeding from said tray of sheets having properties that might otherwise interfere with normal feeding from said tray, said supplemental displacement means comprising a member formed of a material of relatively light specific gravity.

2. In a sheet feeding apparatus in accordance with claim 1, said supplemental displacement means comprising a wedge-shaped member having one end thicker than the opposite end thereof, and said member being disposed on said tray so that its thicker end is positioned under the leading edge of the sheets stacked on said tray.

3. In a sheet feeding apparatus in accordance with claim 2, said wedge-shaped displacement member including a ramp of increasing thickness along the length of said member, and a constant thickness portion extending from and forming a continuation of the thickest portion of said ramp, wherein the constant thickness portion is disposed on said tray under the leading edge of sheets stacked on the tray.

4. In a sheet feeding apparatus in accordance with claims 1, 2 or 3, said supplemental displacement member being selectively removable from and replaceable on said tray as necessary to provide sufficient frictional contact of the uppermost sheet on the tray with said feeding roller for satisfactory feeding of the uppermost sheet.

5. In a sheet feeding apparatus in accordance with claims 1, 2 or 3, said supplemental displacement member further including a sheet of synthetic resin film affixed to a surface of said member atop which sheets are supportable.

* * * * *